US008882537B2

(12) United States Patent
Blanchet et al.

(10) Patent No.: US 8,882,537 B2
(45) Date of Patent: Nov. 11, 2014

(54) CONNECTION ARRANGEMENT, AND ALSO A HOLDING ELEMENT FOR PURPOSES OF CONNECTING AN ELECTRICAL LINE TO A COMPONENT SECTION

(71) Applicant: Airbus Operations GmbH, Hamburg (DE)

(72) Inventors: Guillaume Blanchet, Hamburg (DE); Olivier Marty, Hamburg (DE)

(73) Assignee: Airbus Operations GmbH, Hamburg (DE)

( * ) Notice: Subject to any disclaimer, the term of this patent is extended or adjusted under 35 U.S.C. 154(b) by 79 days.

(21) Appl. No.: 13/657,413

(22) Filed: Oct. 22, 2012

(65) Prior Publication Data

US 2013/0109226 A1 May 2, 2013

Related U.S. Application Data

(60) Provisional application No. 61/549,275, filed on Oct. 20, 2011.

(30) Foreign Application Priority Data

Oct. 20, 2011 (DE) ..... 10 2011 084 900

(51) Int. Cl.

| | |
|---|---|
| ***H01R 13/60*** | (2006.01) |
| ***H01R 4/30*** | (2006.01) |
| ***H01R 13/518*** | (2006.01) |
| *H01R 4/64* | (2006.01) |
| *H01R 11/12* | (2006.01) |

(52) U.S. Cl.

CPC ..... *H01R 13/518* (2013.01); *H01R 4/64* (2013.01); *H01R 4/305* (2013.01); *H01R 11/12* (2013.01)

USPC ..... 439/569

(58) Field of Classification Search

USPC ..... 439/656, 577, 357, 854–855, 685–686, 439/881, 468, 569

See application file for complete search history.

(56) References Cited

U.S. PATENT DOCUMENTS

| | | | | |
|---|---|---|---|---|
| 7,828,585 | B2 * | 11/2010 | Kurimoto | 439/468 |
| 8,323,052 | B2 * | 12/2012 | Sun et al. | 439/564 |
| 8,597,062 | B2 * | 12/2013 | Casses et al. | 439/686 |

* cited by examiner

*Primary Examiner* — Jean F Duverne

(74) *Attorney, Agent, or Firm* — Greer, Burns & Crain Ltd.

(57) ABSTRACT

Disclosed is a connecting arrangement for purposes of connecting an electrical line to a component section, with a holding device, which has a holding element for purposes of arranging on the component section and a connecting element for purposes of connecting the line with the holding element, with a breakthrough to be provided on the component section for purposes of guiding through the connecting element, wherein the holding element is embodied in the form of a clamp for purposes of encompassing the component section in at least some sections, and wherein a positioning device is provided for purposes of positioning the holding element in a design position on the component section, which has a holding element-side positioning element and a counter element to be provided on the component section, which interact in a form fit, and also a holding element for such a connecting arrangement with a clamp-type profile and a positioning element for purposes of a form-fit positioning of the holding element on the component section.

10 Claims, 5 Drawing Sheets

Figure 1:
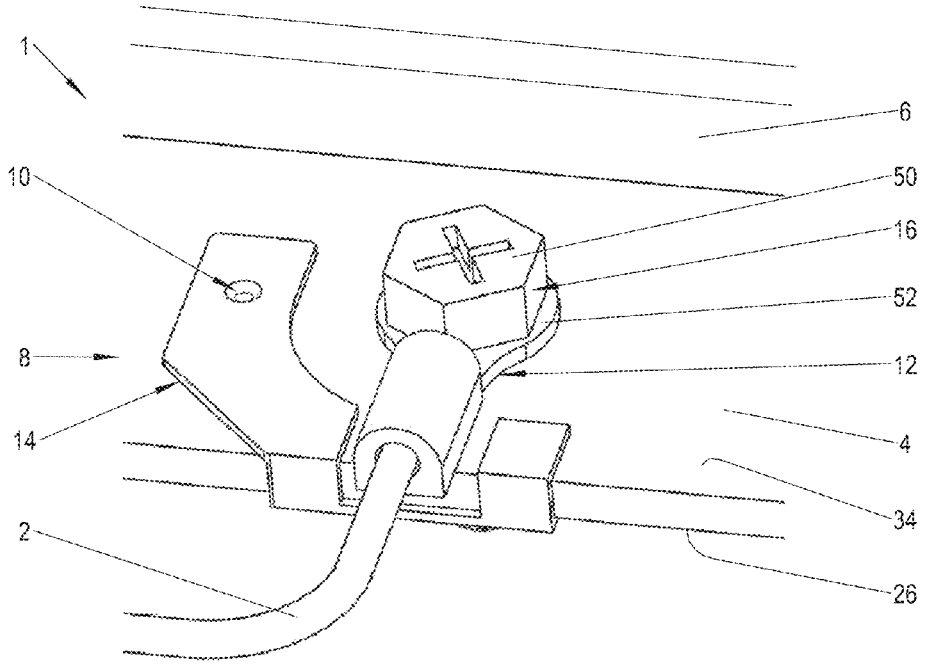
Figure 2:
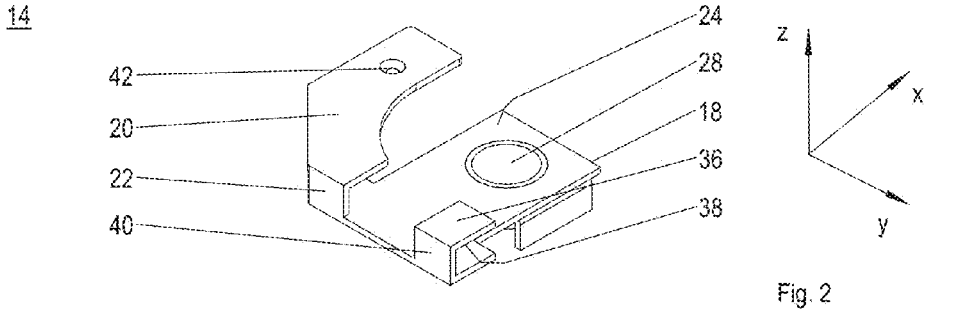
Figure 3:
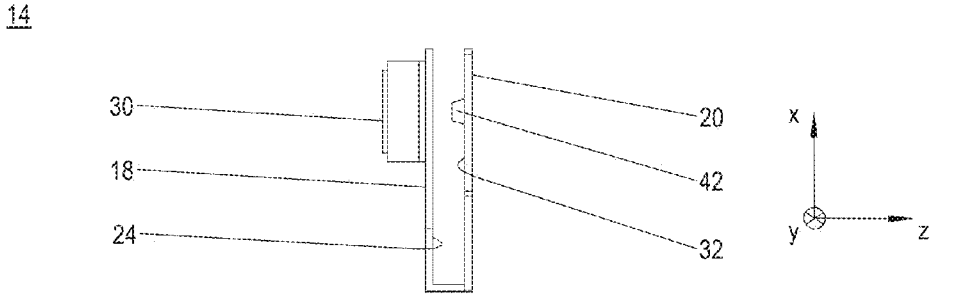
Figure 4:
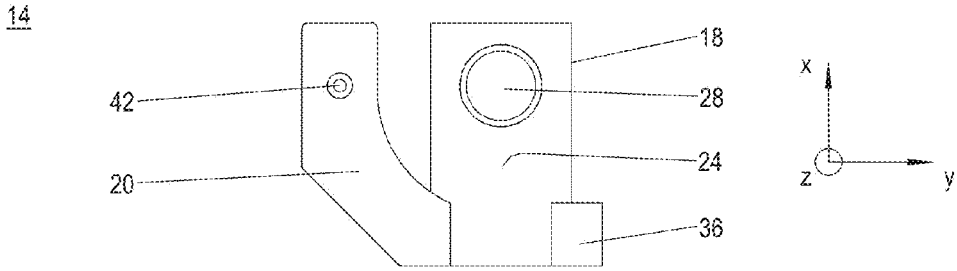
Figure 5:
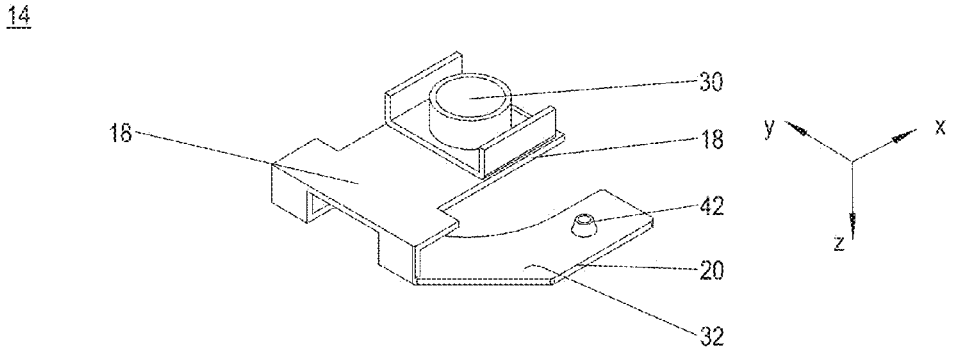

CONNECTION ARRANGEMENT, AND ALSO A HOLDING ELEMENT FOR PURPOSES OF CONNECTING AN ELECTRICAL LINE TO A COMPONENT SECTION

This application claims priority to German Application No. 10 2011 084 900.9 filed Oct. 20, 2011, and claims the benefit of U.S. Provisional Application No. 61/549,275, filed Oct. 20, 2011, the entire contents of each of which are hereby incorporated by reference.

The invention concerns a connection arrangement for purposes of connecting an electrical line to a component section in accordance with the preamble of claim 1, and also a holding element for such a connection arrangement.

Electrical loads in aircraft are regularly earthed. The earthing is undertaken by means of at least one earthing cable, which extends from the load and is connected, for example, to a structural section of the aircraft. In a connection arrangement of known art the connection of the earthing cable to the structural section is undertaken by means of a holding element, a terminal element, and a screw. The holding element has a central internal thread section to receive the screw and two lateral rivet holes to rivet it to the structural section. The attachment element has an attachment section to enable the attachment of the end of the earthing cable, and an eyelet section to enable the screw to be fed through.

For purposes of installing the holding element a structural section is first prepared. To this end an opening and two lateral rivet holes are introduced into the structural section. The holding element is then positioned with its internal thread section on one side of the structural section aligned with the opening, and the rivets are set in place. Next the screw is fed through the terminal element that is connected to the earthing cable, and the terminal element is then secured to the structural section on its counter-side, aligned with the opening by means of the screw. For better electrical contact the area of the structural section with which the terminal element is brought into seating contact is prepared by means of appropriate cleaning operations.

What is particularly disadvantageous in this connection principle of known art is the fact that a multiplicity of operational steps are required to connect the earthing cable to the structural section, and the installation process is therefore correspondingly laborious. Thus rivet holes must be introduced into the structural section and the rivets must be set in place. Moreover the rivets affect the total weight of the connection arrangement disadvantageously. Furthermore the introduction of the rivet holes, the preparation of the rivets, and also the riveting process, are in themselves cost intensive. Moreover the holding element of known art requires a large build space, so that in the case where a multiplicity of holding elements are arranged next to one another these are correspondingly spaced far apart from one another and as a result the earthing cables extending from the electrical loads must be embodied in a correspondingly long manner.

The object of the invention is to create a connection arrangement, which removes the above-cited disadvantages and enables a simplified installation, and also to create a holding element for such a connection arrangement.

An inventive connection arrangement for purposes of connecting an electrical line to a component section has a holding device, which has a holding element to be arranged on the component section, and a connecting element for purposes of connecting the line with the holding element, and also an opening to be provided on the component section to enable the connecting element to be fed through. In accordance with the invention the holding element is embodied in the form of a clamp for purposes of encompassing the component section in at least some sections. Moreover in accordance with the invention a positioning device is provided for purposes of positioning the holding element in a required position on the component section; this has a positioning element on the holding element and a counter-element to be provided on the component section; these act together to produce a form fit.

The combination of the clamp-type design of the holding element and the positioning device enables an automatic arrangement and securement of location of the holding element on the component section in a required position. The holding element is pushed onto the component section until the positioning device latches into position. The holding element is now secured in its location in the required position and the line can be connected by means of the connecting element. In particular in the event of a multiplicity of holding elements on a component section the installation is significantly simplified by means of the automatic positioning in the required position and the securement of location. A riveting process for purposes of arranging the holding element is not necessary. Thus in the inventive solution rivet holes are not necessary in the component section or the holding element, and a riveting process is not required. Furthermore a weight reduction is achieved since the rivets themselves are eliminated. Moreover as a result of the lack of rivet holes an increased component stability is achieved, since the component section is not weakened by rivet holes. Thus a further optimisation of the component is enabled, which results in an additional weight reduction. In addition the inventive solution enables a rapid de-installation of the holding elements.

In one example of embodiment the holding element has a U-shaped profile with a base arm, with a counter-arm spaced apart from the base arm in the vertical direction of the holding element, and with a bar for purposes of connecting the arms. The U-shaped profile enables a simple installation and de-installation of the holding element on the component section by means of a sliding movement. The bar is preferably of a sprung design and thus enables compensation for fluctuations in the wall thickness of the component section.

The arms are preferably arranged displaced relative to one another in the transverse direction of the holding element, wherein in the positioned state a contact space is created on a side of the component section facing away from and quasi-opposite to the base arm, to the side of the counter-arm, for purposes of positioning a line section, i.e. a terminal element connected to a line section. By virtue of the creation of the contact space direct electrical contact, i.e. contact over an area, is enabled between the line section, i.e. the terminal element, and the component section, so that an optimal electrical connection can be made, and electrical contact losses are avoided.

The connecting element preferably serves the additional purpose of locking the holding element. Thus it undertakes two functions. On the one hand it brings about the connection of the line, i.e. of the terminal element, with the holding element and thus the seating on the component section. On the other hand it brings about a translation of the location-secured holding element, located in the required position, into a locked, fixed required position. Additional connecting elements, i.e. means of connection such as adhesive agents, pins and similar, are thus unnecessary for purposes of locking the holding element to the component section.

In one example of embodiment a receptor for the connecting element is introduced for purposes of making an operative connection between the holding element and the connecting element in the base arm. By this means the component section can be clamped between the base arm and the line, i.e. the terminal element, as a result of which any damage of the component section as a result of any one-sided loading is prevented. In particular this example of embodiment is suitable for the use of a rivet as a connecting element, wherein, as viewed from the line i.e. from the terminal element, the base arm is pulled against the component section. and the line, i.e. the terminal element, is pressed against the component section.

In an alternative example of embodiment an internal thread is provided in the region of the receptor. This example of embodiment enables the use of a screw as a connecting element, so that the holding element, and/or the electrical line, can be de-installed in a non-destructive manner. The internal thread is preferably integrated into the hole. Alternatively an integral thread insert, or a thread insert subsequently arranged in the region of the hole, can be provided for purposes of forming the internal thread.

The positioning element is preferably designed as a projection and the counter-element as a recess; each extends transverse to the sliding direction of the holding element, in particular in the vertical direction of the holding element. The projection is simple to manufacture, for example, it can be integrated into the holding element during the manufacture of the latter, and the recess can be simply integrated into the component section after the manufacture of the latter, for example by means of a drilling process. Alternatively the positioning element can be designed as a recess and the counter-element as a projection. The projection, which can be, for example, a peg, a tongue, a pin, a bar, or similar, and also the recess, which can be a hole, groove, or similar, enable a simple and effective form-fit connection, and thus a reliable positioning of the holding element in the required position.

The positioning element is preferably arranged on the counter-arm, as a result of which the installation of the holding element on the component section is eased.

In order to simplify a mutual latching of the elements (positioning element and counter-element) the counter-arm can be of a sprung design.

For purposes of stabilising the holding element in the positioned state on the component section, it can have a stabilising arm, which is arranged to the side of the counter-arm. By this means three seating regions are created between the holding element and the component section in the positioned state, as a result of which the holding element is essentially stabilised in the location-secured required position.

An inventive holding element for such a connection arrangement has a clamp-type profile for purposes of encompassing the component section in some sections, and a positioning element for purposes of a form-fit positioning of the holding element on the component section. Such a holding element is automatically secured on the component section in a required position and moreover is simple to manufacture. Moreover the inventive holding elements can be positioned closer to one another than the holding elements of known art, as a result of which the lines can be shortened.

Other advantageous examples of embodiment of the invention are the subject of further subsidiary claims.

In what follows preferred examples of embodiment of the invention are elucidated in more detail with the aid of highly simplified schematic representations.

Figure 6:
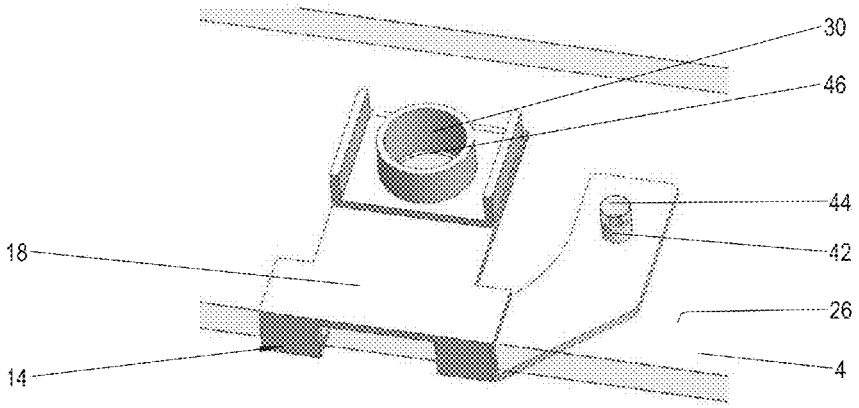
Figure 7:
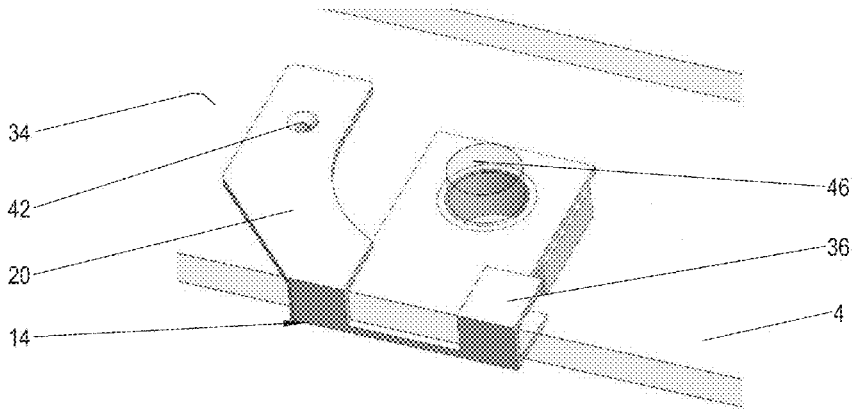
Figure 8:
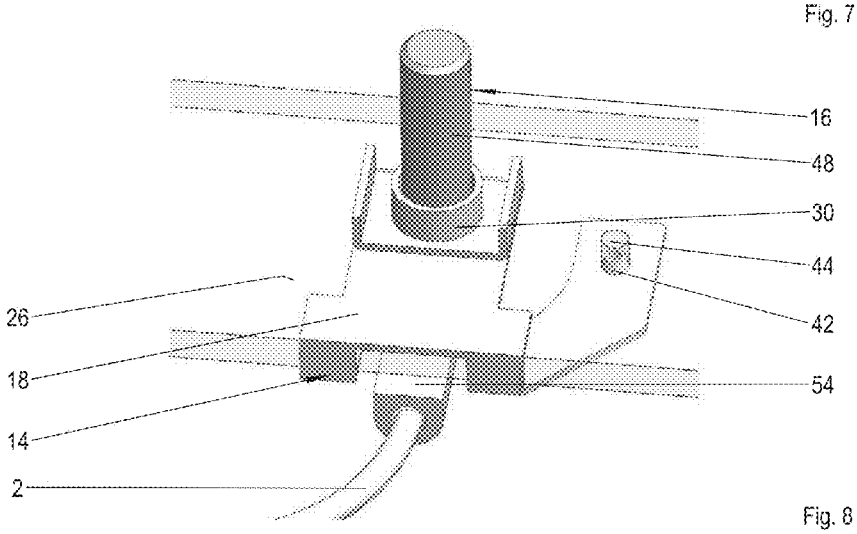
Figure 9:
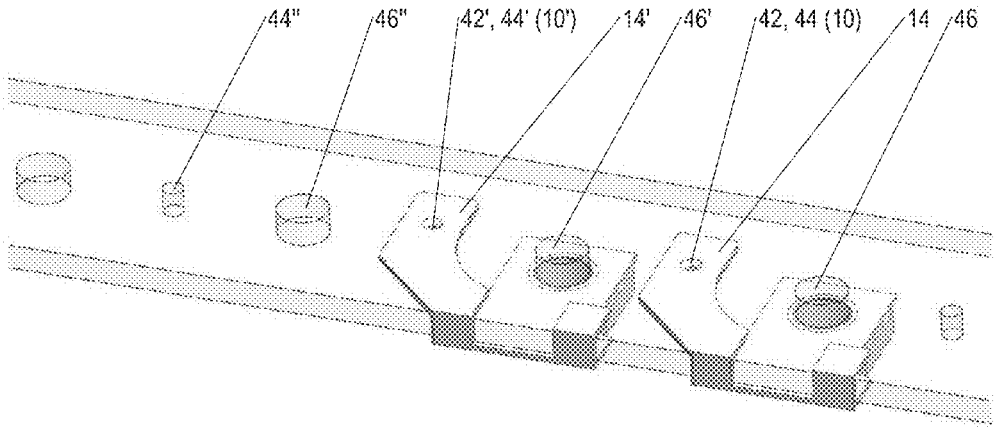
Figure 10:
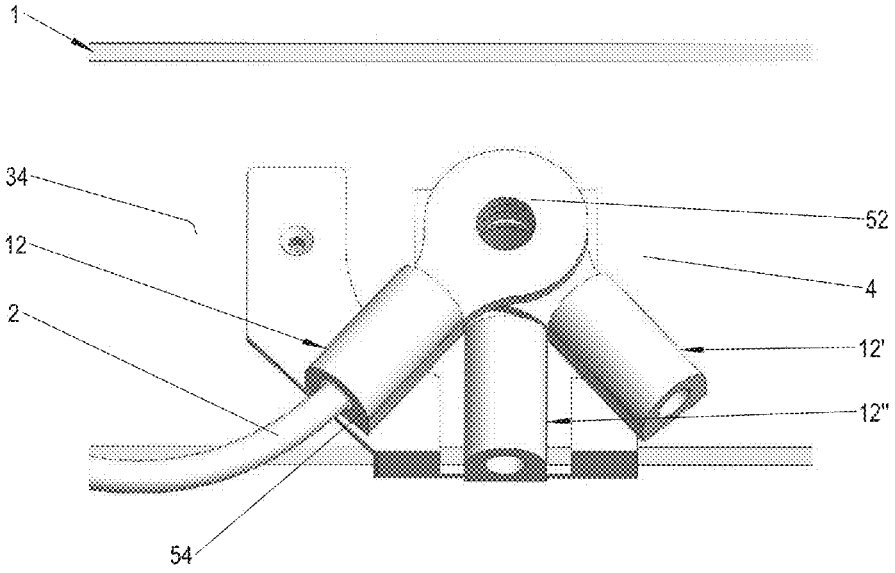
Figure 11:
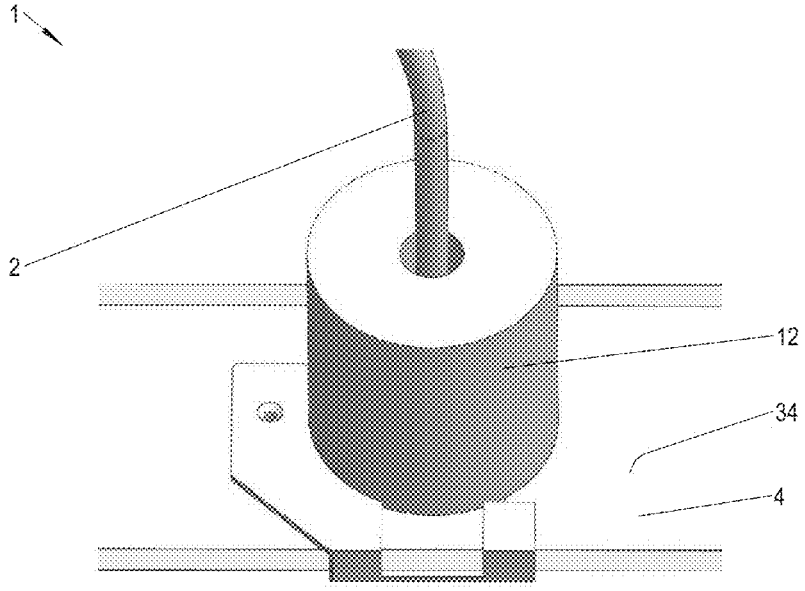

Here:

FIG. 1 shows an inventive connection arrangement with a first terminal element, FIGS. 2 to 5 show individual representations of a holding element of the connection arrangement in accordance with FIG. 1, FIG. 6 shows a view from underneath of the holding element on the component section in a self-secured required position, FIG. 7 shows a view from above onto the holding element on the component section in a self-secured required position, FIG. 8 shows a view from underneath of the connection arrangement, FIG. 9 shows a component section prepared for a multiplicity of holding elements, FIG. 10 shows a connection of a multiplicity of electrical lines by means of a single inventive connection arrangement, and FIG. 11 shows an inventive connection arrangement with a second terminal element.

In FIG. 1 is shown the use of an inventive connection arrangement 1 for purposes of connecting an electrical line 2 to a component section 4 of a component 6. The electrical line is preferably an earthing cable, which extends from an electrical load, for example a cabin component of an aircraft. The component section 4, i.e. the component 6, is, for example, a secondary structure integrated into the aircraft, onto which earthing cables 2 from a multiplicity of electrical loads can be connected.

The connection arrangement 1 essentially has a holding device 8 and also a positioning device 10. At its end the electrical line 2 is preferably provided with an electrically conducting terminal element 12.

The holding device 8 has a holding element 14 and a connecting element 16. The holding element 14 consists of a plastic material, or a corrosion-resistant metal material, or an appropriate metal alloy. For purposes of weight reduction a plastic material is preferably used. It has, as shown in FIGS. 2 to 5, a base arm 18, a counter-arm 20, and also a sprung bar 22 for purposes of connecting the two arms 18, 20. The height of the sprung bar 22 is preferably somewhat smaller than the wall thickness of the component section 4, so that the holding element can easily be pushed onto the component section 4, but is retained on the component section 4 by an inherent spring force.

The base arm 18 has a rectangular geometry with a greater extent in the longitudinal direction x of the holding element 14 than in the transverse direction y of the holding element 14. It has a plane seating surface 24 for purposes of seating over an area of an outer surface 26 of the component section 4 (see FIG. 1). For purposes of receiving the connecting element 16 the base arm 18 has an arm hole 28 in the region of its free head section. For purposes of making an operative connection with the connecting element 16 a thread insert 30 with an internal thread is arranged on the rear side of the seating surface 24. The thread insert can be designed integrally with the latter, or can be attached to the base arm 18 subsequently.

The counter-arm 20 has a sickle-type shape and, as viewed in the longitudinal direction x of the holding element 14, runs to the side of the base arm 18. Thus the arms 18, 20 are arranged displaced relative to one another, as viewed in the transverse direction y of the holding element 14. The two arms 18, 20 are thereby displaced relative to one another in the transverse direction y such that to the side of the counter-arm 20 a contact space is created for purposes of positioning the terminal element 12 on a side of the component section 4 facing away from the base arm 18, so that the terminal element 12 can be brought directly into seating contact over an area with the component section 4. The counter-arm 20 has a plane contact surface for purposes of seating over an area of a counter-surface 34 (FIG. 1) of the component section 4 opposed to the outer surface 26. The counter-arm 20 is preferably of a sprung design.

Moreover the holding element 14 has a stabilising arm 36, which is arranged opposite the base arm 18 and to the side of the counter-arm 20 as an opposing side boundary to the contact space. The stabilising arm 36 has a plane stabilising surface 38 for purposes of seating on the counter-surface 34 of the component section 4, and is connected to the base arm 18 via a sprung bar 40 that is spaced apart from the sprung bar 22 of the counter-arm 20. Thus the holding element 14 has three seating regions (seating surface 24—outer surface 26, contact surface 32—counter-surface 34, stabilising surface 38—counter-surface 34), which, as viewed in the x-y plane, are arranged relative to one another in the form of a quasi-triangle, so that a high degree of stabilisation of the holding element 14 is achieved in the positioned and self-secured state on the component section 4. The stabilising arm 36 preferably has a rectangular shape with a longitudinal extent, wherein, compared with the base arm 18 it is significantly shorter in the longitudinal direction x, and encompasses the component section 4 just in the edge region. In the example of embodiment shown the stabilising arm 36 and also the counter-arm 20 are arranged displaced laterally outwards in the sprung bar region in comparison to the base arm 18, for purposes of optimising the stabilisation The positioning device 10 serves to secure the holding element 14 in a required position on the component section 4. As enumerated in FIGS. 2 to 5, it has a positioning element 42, and, as enumerated in FIG. 6, a counter-element 44, which in the latched state form a releasable form fit with one another.

The positioning element 42 is arranged on the holding element and is preferably designed as a projection integrated in the head region of the counter-arm 20, which extends in the vertical direction z of the holding element and thus transverse to the sliding direction of the holding element 14.

The counter-element 44 (FIG. 6) is designed on the component section and is designed to be complementary to the positioning element 42. In the example of embodiment shown the counter-element 44 is designed as a continuous hole, which extends transverse to the sliding direction of the holding element 14, and in particular, in the installed state extends in the vertical direction z of the holding element 14 to the side of an opening 46 of the connection arrangement 1.

The opening 46 is a continuous hole provided in the component section 44 to enable the connecting elements 16 to be fed through. It extends transverse to the sliding direction of the holding element 14, and in particular, in the installed state it extends in the vertical direction z of the holding element 14.

The connecting element 16 has the form of a pin and in particular is designed as a screw. It serves the purpose of screwing the terminal element 12 to the holding element 14 and at the same time of locking the holding element 14 in the required position. In accordance with FIG. 8 the connecting element 16 with its threaded shank 48 can be brought into an operative connection with the internal thread of the thread insert 30, and when screwed into position clamps an eyelet section 52 of the terminal element 12 between its screw head 50 and the counter-surface 34 (cf FIG. 1).

In what follows a preferred method for providing a terminal connection between an electrical line 2 and a component section 4, for example, between an earthing cable and a structural section of an aircraft, is explained by means of the inventive connection arrangement 1.

The component section 4 is firstly prepared. To this end the opening 46 and the counter-element 44 are introduced into the component section. The opening 46 is then cleaned in the region in which it opens out on the side of the counter-surface, for purposes of improving the electrical contact between the terminal element 14 and the component section 4.

Next the holding element 14 is positioned on the component section 4 in its required position (FIGS. 6 and 7). To this end the holding element 14 is pushed onto the component section 4 until the positioning element 42 latches into the counter-element 44. The holding element 14 with its arms 18, 20, 36 is now seated over an area of the component section 4, and is thereby oriented with its arm hole 28 in alignment with the opening 46. The holding element 14 is now translated into its required position and is releasably latched with the component section 4, i.e. it is location-secured in the required position by means of the positioning device 10.

The line 2 is then connected (FIGS. 1 and 8). To this end the connecting element 16 is fed through the eyelet section 52 of the terminal element 12 connected to the line 2, with its threaded shank 48 it is then fed through the opening 46 and the arm hole 28, and is then screwed into the thread insert 30. During the screwing process the base arm 18 is pulled against the outer surface 26 and the eyelet section of the terminal element 12 is clamped between the counter-surface 34 of the component section 4 and the screw head 50. By virtue of the sprung bars 22, 40 seated against the edge region of the component section 4, and the positioning device 10, any rotation of the holding element 14 is thereby prevented, so that the line can be screwed on in a quasi-one-handed manner. The terminal element 12 is now seated directly on the counter-surface 34 of the component section 4 in the contact space between the counter-arm 20 and the stabilising arm 36, quasi-opposite to the base arm 20, and thus forms an electrical contact with the counter-surface 34 over an area. The terminal element 12 is thereby secured against any alteration of location, inasmuch as it is pressed against the counter-surface 34 by the connecting element 16. At the same time the holding element 14 is pulled against the outer surface 26 by the connecting element 16, so that it is also fixed in location, i.e. locked, in particular it is releasably locked. The terminal element 12, and thus the line 2, is mechanically and electrically connected with the component section 4 by means of the holding element 14 in conjunction with the connecting element 12.

In the event that a multiplicity of lines 2 are to be connected to the component section 4, as shown in FIG. 9, all openings 46, 46', 46" and counter-elements 44, 44', 44" are, of course, first introduced into the component section 4 and only then are the holding elements 14, 14' positioned on the component section 4 in their respective required positions. The respective positioning devices 10 thereby enable, in combination with the clamp profiles of the holding elements 14, 14', a rapid and simple positioning of the holding elements 14, 14' in their respective required positions. Moreover by means of the respective positioning devices 10 and the clamp profiles any alteration of location of the holding elements 14, 14' that are located in their required positions is prevented. Furthermore the narrow lateral spacing of the holding elements 14, 14' relative to one another is shown in FIG. 9.

As shown in FIG. 10, a single inventive connection arrangement 1 enables the connection of a multiplicity of electrical lines 2, i.e. electrical terminal elements 12, 12', 12", which in each case have a flat and extended profile with an eyelet section 52 and a terminal section 54. To this end the terminal elements 12, 12', 12". with their eyelet sections 52 rotated above one another about a common eyelet axis. are pushed onto a connecting element, not shown, and by means of the connecting element are at least mechanically connected with the holding element 14, and at least electrically connected with the component section 4. The connecting element, not shown, is unaltered with respect to the screw-type connecting element 16 described above.

In accordance with the representation in FIG. 11 the inventive connection arrangement 1 similarly enables the use of a terminal element 12 in the form of a cylinder, the front face of which is seated against the counter-surface 34 of the component section 4, and thus forms electrical contact with the latter over an area. A line 2 is, for example, fed into the terminal element 12 on its rear face. A connecting element, not shown, is oriented coaxially with the terminal element 12 and is inserted into the terminal element 12 on its rear face. In principle, the connecting element, not shown, is unaltered with respect to the connecting element 16 described above.

Disclosed is a connection arrangement for purposes of connecting an electrical line to a component section, with a holding device, which has a holding element to be arranged on the component section and a connecting element for purposes of connecting the line with the holding element, with an opening to be provided on the component section to enable the connecting element to be fed through, wherein the holding element is embodied in the form of a clamp for purposes of encompassing the component section in at least some sections, and wherein a positioning device is provided for purposes of positioning the holding element in a required position on the component section, which positioning device has a positioning element on the holding element and a counter-element to be provided on the component section; these act together to produce a form fit; also disclosed is a holding element for such a connection arrangement with a clamp-type profile and with a positioning element for purposes of a form-fit positioning of the holding element on the component section.

REFERENCE SYMBOL LIST

1 Connection arrangement
2 Electrical line
4 Component section
6 Component
8 Holding device
10 Positioning device
12 Terminal element
14 Holding element
16 Connecting element
18 Base arm
20 Counter-arm
22 Sprung bar
24 Seating surface
26 Outer surface
28 Arm hole
30 Thread insert
32 Contact surface
34 Counter-surface
36 Stabilising arm
38 Stabilising surface
40 Sprung bar
42 Positioning element
44 Counter-element
46 Opening
48 Threaded shank
50 Screw head
52 Eyelet section
54 Terminal section
x Holding element longitudinal direction
y Holding element transverse direction
z Holding element vertical direction

The invention claimed is:

1. A connection arrangement to connect an electrical line to a component section with a holding device, comprising:

a holding element of the holding device to be arranged on the component section, a connecting element on the holding device to connect the electrical line with the holding element, and an opening in the component section configured to enable the connecting element to be fed through, the holding element being embodied in the form of a clamp configured to slidingly encompass the component section in at least some sections, the holding element including a positioning device arranged to position the holding element in a required position on the component section, which positioning device has a positioning element on the holding element and a counter-element provided on the component section, the positioning element and the counter-element acting together to produce a form fit, the holding element having a U-shaped profile with a base arm, with a counter-arm spaced apart from the base arm in the vertical direction of the holding element, and with a bar connecting the arms.

2. The connection arrangement in accordance with claim 1, wherein the arms are arranged displaced relative to one another in the transverse direction of the holding element, and in the positioned state, a contact space is created on a side of the component section facing away from the base arm, to the side of the counter-arm, to position a terminal element of the electrical line on the component section.

3. The connection arrangement in accordance with claim 1, wherein the connecting element locks the holding element to the component section.

4. The connection arrangement in accordance with claim 1, wherein a receptor is located in the base arm to receive the connecting element.

5. The connection arrangement in accordance with claim 4, wherein an internal thread is provided in a region of the receptor.

6. A connection arrangement to connect an electrical line to a component section with a holding device, comprising:

a holding element of the holding device to be arranged on the component section, a connecting element on the holding device to connect the electrical line with the holding element, and an opening in the component section configured to enable the connecting element to be fed through, the holding element being embodied in the form of a clamp configured to slidingly encompass the component section in at least some sections, the holding element including a positioning device arranged to position the holding element in a required position on the component section, which positioning device has a positioning element on the holding element and a counter-element provided on the component section, the positioning element and the counter-element acting together to produce a form fit, the positioning element comprising a projection, and the counter-element comprising a recess, the projection and the recess each extending transverse to a sliding direction of the holding element.

7. The connection arrangement in accordance with claim 6, wherein the positioning element is located on the counter-arm.

8. The connection arrangement in accordance with claim 7, wherein the counter-arm is a spring.

9. The connection arrangement in accordance with claim 1, wherein the holding element includes a stabilising arm arranged to the side of the counter-arm.

10. A holding element for a connection arrangement to connect an electrical line to a component section, comprising the holding element being in the form of a clamp configured to encompass the component section in at least some sections, a positioning device on the holding element arranged to position the holding element in a required position on the component section, which positioning device has a positioning element configured to form fit with a counter-element on the component section with a form fit, the holding element having a U-shaped profile with a base arm, with a counter-arm spaced apart from the base arm in the vertical direction of the holding element, and with a bar connecting the arms.

* * * * *